United States Patent [19]

McEwan

[11] Patent Number: 4,726,271

[45] Date of Patent: Feb. 23, 1988

[54] ROTARY CUTTING MACHINE

[75] Inventor: Thomas K. McEwan, Redmond, Wash.

[73] Assignee: Elliott Bay Industries, Inc., Seattle, Wash.

[21] Appl. No.: 921,988

[22] Filed: Oct. 21, 1986

[51] Int. Cl.[4] ..... B26D 7/06; B26D 1/28

[52] U.S. Cl. ..... 83/155; 83/162; 83/346; 83/365; 83/368; 83/591; 144/230; 144/356

[58] Field of Search ..... 144/2 R, 218, 230, 356; 83/155, 162, 302, 342, 343, 346, 347, 591, 365, 368

[56] References Cited

U.S. PATENT DOCUMENTS

| | | |
|---|---|---|
| 219,205 | 9/1879 | Braley . |
| 2,369,253 | 6/1943 | Robinson et al. . |
| 3,192,809 | 5/1963 | Crouch et al. . |
| 3,566,734 | 11/1968 | Robinson . |
| 3,808,925 | 5/1974 | Hards . |
| 3,859,879 | 1/1975 | Spengler . |
| 4,014,234 | 3/1977 | Spengler . |
| 4,397,204 | 8/1983 | Colombo . |

*Primary Examiner*—W. D. Bray

*Attorney, Agent, or Firm*—Christensen, O'Connor, Johnson & Kindness

[57] ABSTRACT

A rotary cutting assembly for cutting sheets of veneer as they are moving on a conveyor belt is provided. The rotary cutting assembly (10) includes at least one rotary blade assembly (12), a conveyor belt (20) for conveying material and acting as a cutting surface, a flexible flat platen (40) positioned under the inner surface (36) of the conveyor belt (20) in vertical alignment with the rotary blade assembly (12), and a backup roller (26) positioned above the rotary blade assembly (12). The rotary blade assembly (12) includes an elongated blade holder (64) with opposed sides (66 and 68) that taper outwardly to define opposed edges (70 and 72) having longitudinal channels (74 and 76). A clamping assembly (62) that includes a grooved clamp (84) and a tapered bar (86) securely clamps a blade (18) within each of the channels (74 and 76).

11 Claims, 5 Drawing Figures

ROTARY CUTTING MACHINE

TECHNICAL FIELD

This invention relates to cutting machines and more particularly to a rotary cutting machine for cutting veneer.

BACKGROUND OF THE INVENTION

Veneer cutting machines are used to cut out defective sections of large sheets of wood veneer. The veneer sheets are fed to the cutting machine by means of rollers or conveyor belts. Before a veneer sheet reaches the cutting machine, it passes under a defect scanner that locates defects in the veneer sheet. As the veneer sheet reaches the cutting machine, the defect scanner signals one or more blades to cut the sheet both in front of and behind the defect. After the sheet leaves the cutting machine the excised defective section is removed.

A veneer cutting machine must be capable of making a transverse cut across a sheet of veneer as the veneer sheet is moving along the rollers or conveyor belt. Older prior art machines dropped a weighted blade, similar to a guillotine, or used a motorized chopping blade to make the cut. This type of cutting resulted in a momentary stopping of the veneer sheet as well as frequent binding between the wood and the blade as the blade was withdrawn. To avoid this binding, the sheets of veneer were moved at very slow speeds. More recent cutting machines utilize a rotating blade that moves with the veneer sheet as the blade is cutting. Successive cuts can either be made by the same blade or by two separate rotating blades. In either case, rotating blades permit faster movement of the veneer sheet as it is being cut. While the speed of the rotating blade is related to the mass of the blade assembly, use of lighter materials to construct the relatively long blade assemblies results in a flexing at the center portion of the blade assembly. This flexing prevents a clean cut from being made across the veneer sheet. A backup roller positioned above the rotating blade assembly is used to prevent flexing. An additional backing member is located underneath the veneer sheet to provide a cutting surface for the blade. In the past, backing members have usually consisted of large, heavy rotating rollers that also assist in movement of the veneer sheets as they are being cut. The disadvantage of backing rollers is that they are expensive to maintain and cumbersome to change. Another disadvantage to using backing rollers is the difficulty in finely aligning the roller with the blade to maintain uniform pressure between the blade and the cutting surface of the roller.

SUMMARY OF THE INVENTION

In accordance with this invention, a rotary cutting machine for transversely cutting large sheets of material is provided. The rotary cutting machine includes: at least one rotary blade assembly; a conveyor belt for conveying material to and away from the region beneath the rotary blade assembly, having an outside surface that acts as cutting surface for the rotary blade assembly, and an inside surface; a flat platen positioned beneath the inside surface of the conveyor belt in vertical alignment with the rotary blade assembly for supporting the conveyor belt when it is acting as a cutting surface; and, at least one backup roller positioned above the rotary blade assembly for preventing longitudinal bending or flexing of the rotary blade assembly when it is in a cutting position. In addition, rotating means for rotating the rotary blade assembly is provided.

In accordance with other aspects of this invention. the flat platen is formed of a flexible low-friction material acting as a bearing surface that is held in place by a bearing surface holder. The bearing surface and the bearing surface holder form a cavity capable of holding a gas or fluid under pressure such that a change in the air or gas pressure inside the cavity causes the flexible surface to flex, thereby permitting minute changes in the pressure between the blade and the cutting surface of the conveyor belt.

In accordance with further aspects of this invention, the rotary blade machine comprises an elongated blade holder having a pair of opposed sides that taper outwardly toward one another from a central location to define a pair of opposed edges such that the distance between the edges is substantially greater than the distance between the sides at the central location. Longitudinal channels are formed in each of the oppositely-disposed sides. A blade is removably retained in each of the channels, and a clamping means securely clamps the blade in each channel.

In accordance with still further aspects of this invention, the clamping means comprises a clamping assembly located in each of the longitudinal channels, each assembly comprising a tapered bar positioned on one side of the blade retained in the associated channel, a grooved clamp positioned on the other side of the blade retained in the associated channel, and a plurality of threaded members mounted in the elongated blade holder and oriented to press the grooved clamp against the blade and tapered bar to securely clamp the blade within the associated channel.

As will be readily appreciated from the foregoing description, the invention provides a rotary cutting machine having a conveyor belt that conveys material to and away from the region beneath the rotary blade assembly and acts as a cutting surface for the rotary blade. A flexible flat platen positioned beneath the conveyor belt supports the conveyor belt when it is acting as a cutting surface and provides minute adjustments in the pressure between the blade and the conveyor belt to thereby insure a clean cut across the material and increase the blade and belt life. The rotary blade assembly has a low mass to increase the speed of the cutting action and a clamping assembly that securely holds the blade as well as permits easy replacement of worn or damaged blades.

BRIEF DESCRIPTION OF THE DRAWINGS

The foregoing and other advantages and features of this invention will become more readily appreciated as the same becomes better understood by reference to the following detailed description when taken in conjunction with the accompanying drawings wherein.

DESCRIPTION OF THE PREFERRED EMBODIMENT

Figure 1:
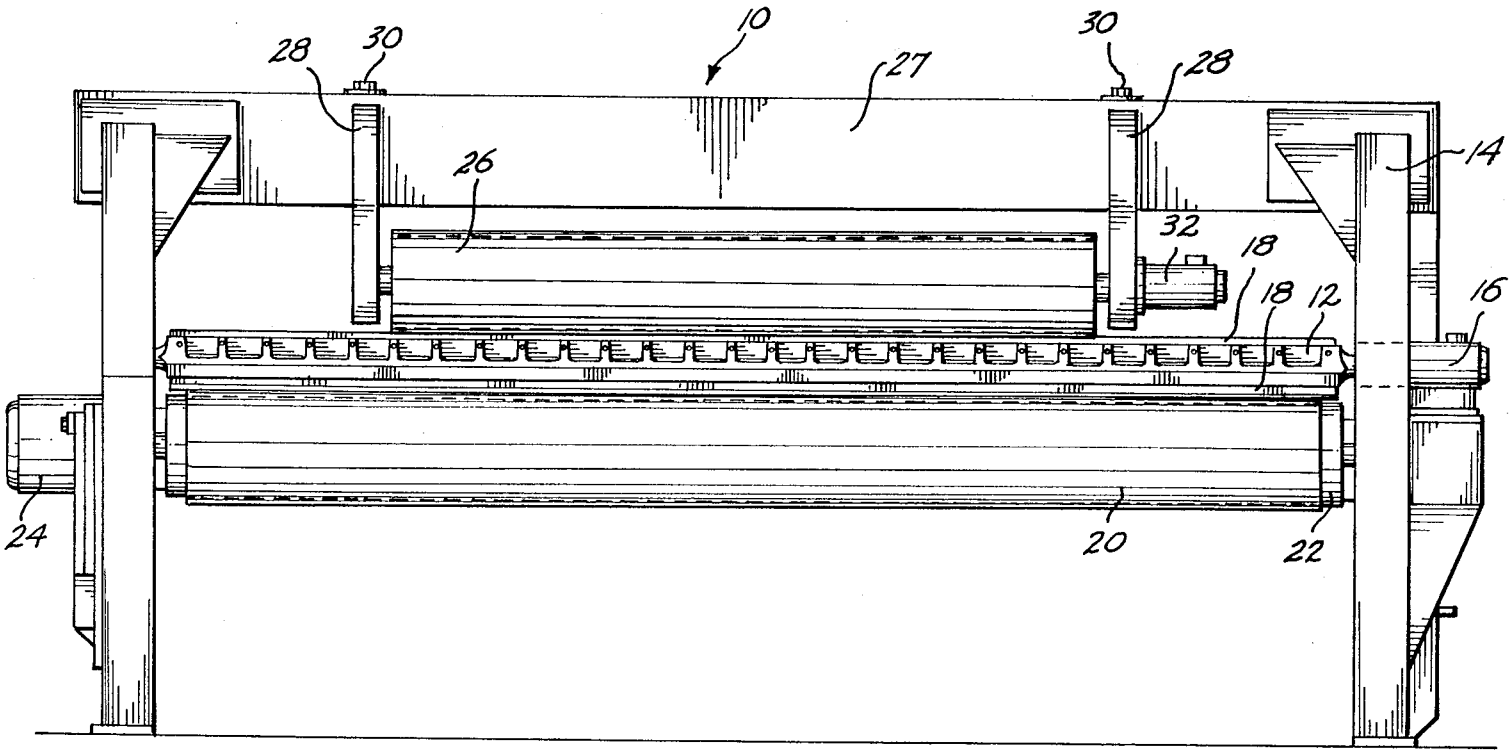
FIG. 1 is a longitudinal side elevational view of a preferred embodiment of the invention.
Figure 2:
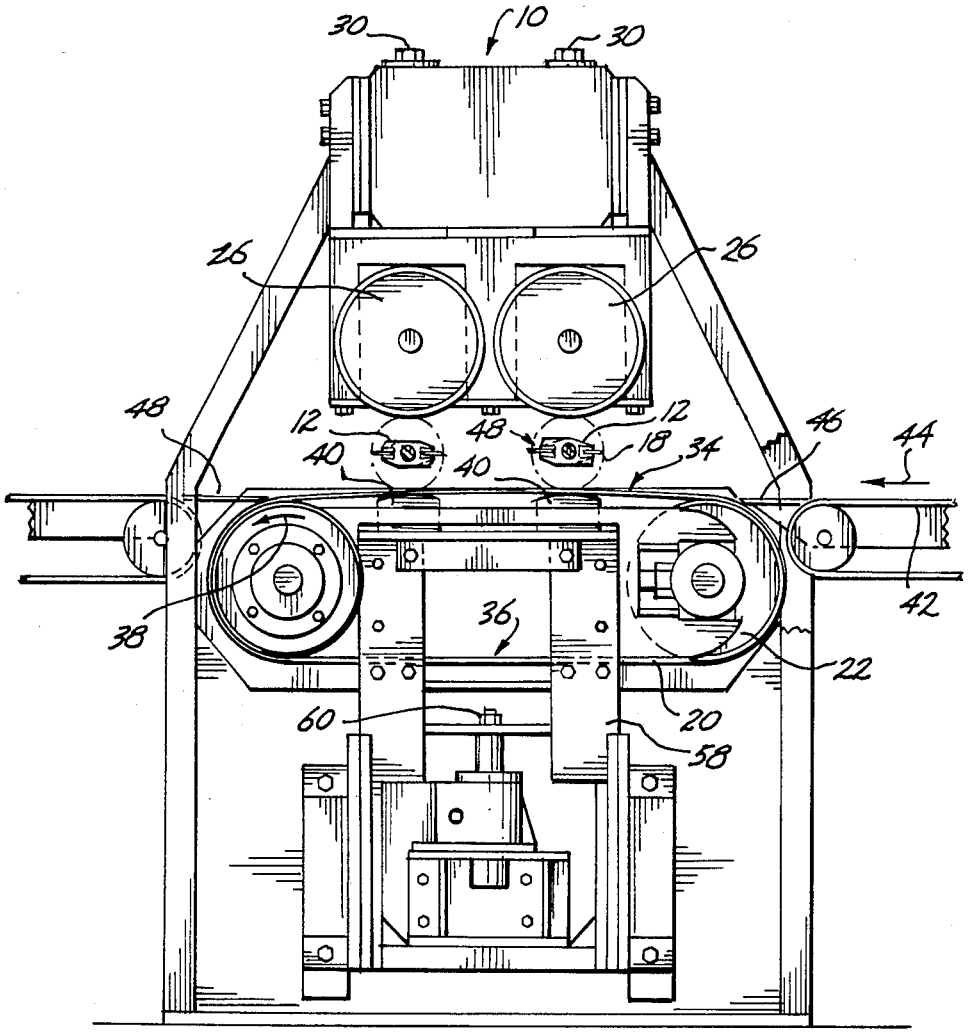
FIG. 2 is a side elevational view, partially in cross section of the embodiment of the invention illustrated in FIG. 1.

FIGS. 1 and 2 show a rotary cutting machine 10 formed in accordance with the present invention. The rotary cutting machine includes two elongate rotary blade assemblies 12 rotatably mounted side-by-side on a frame 14 and driven by a blade motor 16. Each rotary blade assembly 12 includes two oppositely-disposed blades 18 positioned to transversely cut large sheets of veneer that is conveyed to and away from the blades by a conveyor belt 20. The conveyor belt 20 is driven by conveyor drums 22 that are in turn powered by belt motor 24. A backup roller 26 is positioned above each blade assembly 12 to prevent the blade assembly 12 from flexing upward when it is in a vertical cutting position. The backup roller 26 is rotatably mounted to the vertical supports 28 suspended from an overhead beam 27 that forms part of the frame 14. Vertical adjustment of the backup rollers 26 is made by rotating vertically oriented adjusting bolts 30. In addition the backup rollers 26 are powered by backup motor 32.

The conveyor belt 20 has an outside surface 34 that acts as a cutting surface for each of the blade assemblies 12. Regular stamping belt material may be used for the outer surface 34, such as a polyurethane belt having a nylon inside surface 36. This inside surface 36 bears against the conveyor drums 22 that rotate the conveyor belt 20 in a counterclockwise direction as shown by the directional arrow 38. Two platens 40 are mounted in vertical alignment with the rotary blade assemblies 12 between the conveyor drums 22 and underneath the inside surface 36. The platens provide support for the conveyor belt 20 when it is acting as a cutting surface.

When the rotary cutting machine 10 is in operation, infeed belts 42 transport large sheets of veneer to the conveyor belt 20 in the directions shown by infeed arrows 44. The gap between the conveyor belt 20 and the infeed belt 42 is covered by bridge 46. Conveyor belt 20 provides a large supporting surface for the veneer sheets as they are brought underneath the rotary blade assemblies 12. A cut is made by rotating the blade assembly in a clockwise position to bring the blade 18 into contact with the veneer sheets. The speed of the cutting edge of the blades 18 is the same as the sheets of veneer moved by the conveyor belt 20. As a blade 18 cuts through a veneer sheet, it bears against the underlying outer surface 34 of the conveyor belt. Platen 40 provides support to the conveyor belt 20 to maintain proper pressure between the blade 18 and the outer surface 34 of the belt.

When the rotary cutting machine 10 is in operation, infeed belt 42 supplies sheets of veneer to the conveyor belt 20 in the direction indicated by infeed arrows 44. Bridge 46 acts to provide a smooth transition over the gap between the infeed belt 42 and the conveyor belt 20. The conveyor belt 20 provides a large supporting surface for the sheets of veneer as they are brought to a cutting position underneath the rotary blade assemblies 12. Once a sheet is cut, it is conveyed away over bridge 48 to the outfeed belt 50.

Figure 3:
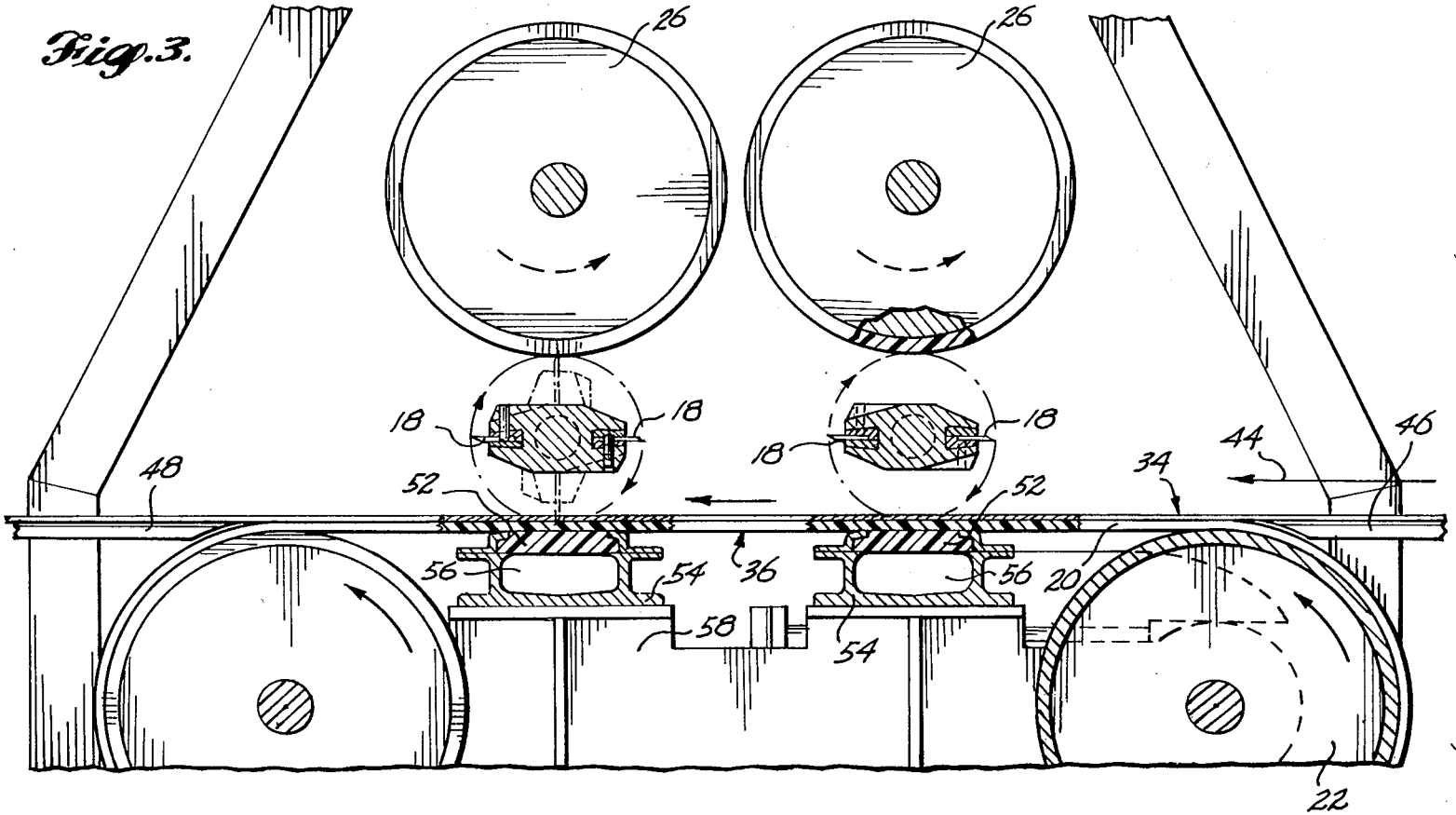
FIG. 3 is an enlarged, partial cross-sectional view of the embodiment of the invention illustrated in FIG. 2.

FIG. 3 shows the construction of the platens 40 in greater detail. The inside surface 36 of the conveyor belt 20 rests on a bearing surface insert 52. The bearing surface insert 52 is held in place by a bearing surface holder 54. The bearing surface insert 52 and the bearing surface holder 54 define an enclosed cavity 56. While bearing surface insert 52 may be constructed of a relatively stiff material having a low-friction coefficient, such as metal, more preferably, the bearing surface insert 52 is constructed of a flexible low-friction material so that it can respond to changes in the pressure inside the cavity 56. The cavity 56 may be filled with a gas, such as air, or more preferably a noncompressible fluid, such as water. The fluid is maintained pressurized, preferably in the pressure range of 20 to 60 pounds per square inch. A flexible bearing surface insert 52 and a fluid pressurized cavity 56 allows the bearing surface insert 52 to change height and push up on the conveyor belt 20, or vice versa. In this way fine adjustments in the pressure between the blade 18 and the outside surface 34 is provided by the invention. Because of the lack of complexity, an operator can quickly and easily adjust the rotary blade assembly pressure to ensure clean cuts are made and to prevent binding between the conveyor belt 20 and the platen 40, thereby lessening the wear on conveyor belt 20 and prolonging the life of the blade 18. Gross adjustments in height are made by vertically adjusting the platen frame 58 using a jackscrew 60, as shown in FIG. 2.

Figure 4:
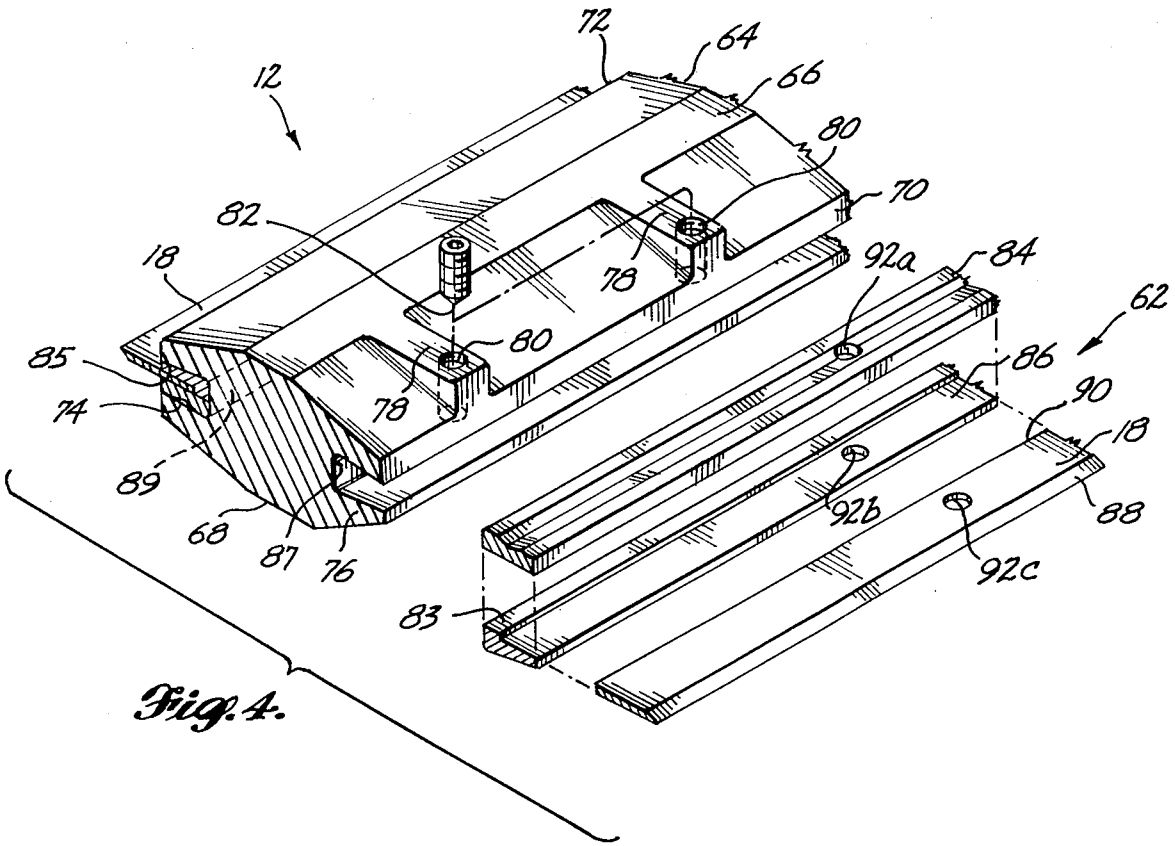
FIG. 4 is an isometric, partial sectional, exploded view of the rotary blade portion of the rotary cutting machine formed in accordance with the present invention; and, FIG. 5 is a pictorial view of a control circuit, partially in block form, suitable for controlling the embodiment of the invention illustrated in FIGS. 1 and 2.

FIG. 4 is an exploded isometric view of the rotary blade portion of the rotary blade assembly 12. As shown there, each rotary blade assembly includes a pair of elongate clamping assemblies 62 and an elongate blade holder 64. The blade holder 64 has a pair of opposed sides 66 and 68 that taper outwardly toward one another from a central location to define a pair of opposed edges 70 and 72. The distance between the opposed edges 70 and 72 is substantially greater than the distance between the opposed sides 66 and 68 at the central location of the blade holder 64. Longitudinal channels 74 and 76 are formed along the edge of each of the oppositely-disposed edges 70 and 72. Spaced apart, raised protrusions 78 located on the opposite alternate sides of blade holder 64 provide support for holes 80 in which threaded set screws 82 are inserted.

Each clamping assembly 62 includes a longitudinally grooved clamp bar 84 and a tapered bar 86. Each of the blades 18 are formed of a flat elongate piece of steel having a cutting blade formed along one longitudinal edge. The other longitudinal edge 90 is square. One surface of the tapered bar 86 is undercut to provide a pocket for receiving the blade 80. The undercut is such that a thin rail 83 extends along the thicker edge of the tapered bar. The blade is positioned in the pocket such that the cutting edge projects outwardly. Located on the side of the blade remote from the tapered bar is the grooved clamp bar positioned such that the elongate groove faces away from the blade. Preferably, the facing surfaces 87 and 89 of the channels 74 and 76 diverge inwardly, and the tapered bar 86 has a tapered surface that cooperates with the diverging channel surfaces to allow insertion and removal of the clamping assembly 62 only by longitudinally sliding the clamping assembly 62 into the longitudinal channels 74 and 76 from one end. The blades 18 are clamped between the grooved clamp bars 84 and the tapered bars 86 by the threaded set screws 82. The blades 18 may be aligned within the clamping assemblies 62 by having a few of the threaded set screws 82 extend through holes 92*a*, *b* and *c* in grooved clamp bar 84, blade 18, and tapered bar 86. In order to minimize the mass of the rotary blade assemblies, preferably, the blade holders 64 are formed of aluminum. The tapered bars 86 are preferably formed of steel to provide a wear resistant surface for the back edge of the blades 18.

Figure 5:
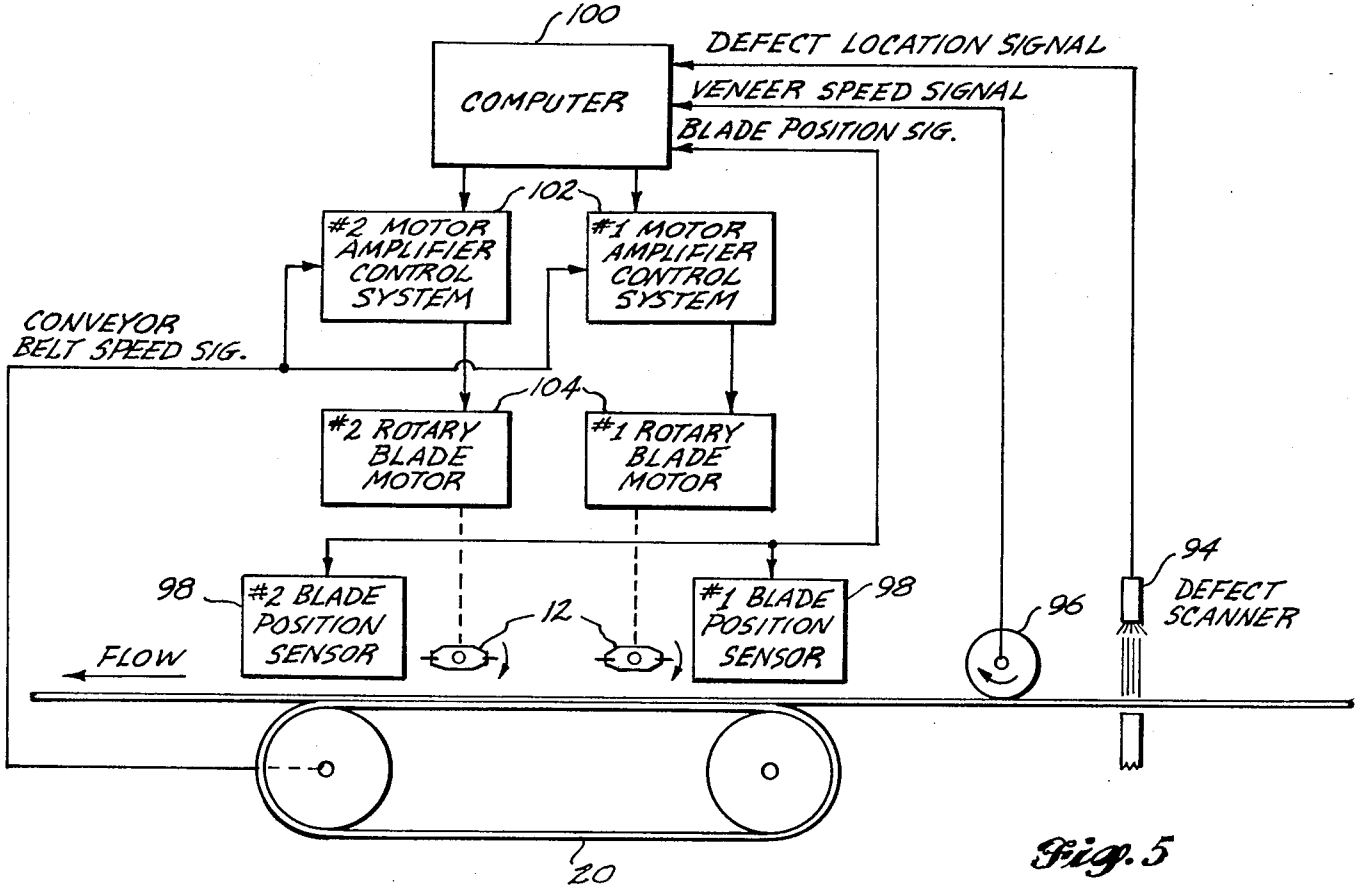

FIG. 5 illustrates a computer control system for a rotary cutting assembly 10 formed in accordance with the invention to cut out defective portions of large sheets of veneer. As the veneer is brought to the rotary cutting assembly it passes beneath a defect scanner 94. When the defect scanner 94 detects a defect, it sends a defect location signal to a computer 100 that indicates the location of the defect. The speed of the veneer as it moves along the infeed belt 42 is monitored by a speed monitor 96, which sends veneer speed signals to the computer. In addition, blade position sensors 98 sense the position of the blade assemblies 12, i.e., whether the blade assemblies 12 are in a vertical cutting position or a horizontal position, and send related blade position signals to the computer. The computer 100 in turn generates cut signals, which are amplified by motor amplifier control systems 102 and sent to the rotary blade motors 104. The computer 100 and the motor amplifier control systems cooperate to coordinate the speed of the rotary blade assemblies 12 as they rotate to the vertical cutting position so that blade speed matches the speed of the passing veneer. The computer 100 determines which blades will make the cut on the basis of the proximity of the cuts. Generally, the downsteam rotary blade assembly 12 will do most of the cutting. If a cut is required to be made closer than the circumferential distance between the blades 18 of the downstream rotary blade assembly 12, the cut will be made by the upstream rotary blade assembly 12. The circumferential distance between the blades 18 on the rotary blade assembly 12 is a measure of one-half the circumference of a circle drawn about the tips of the blades 18. The determination as to which rotary blade assembly 12 will be used is made by the computer 100 from stored tables.

The rotary cutting machine 10 can also be configured as a single rotary blade system. Cuts can be made closer than the distance between the blades 18 by accelerating the rotary blade assembly 12 between cutting actions. The effect of shortening the distance between cuts becomes more pronounced as the speed of the veneer is reduced. It is possible to reduce the distance between cuts to less than one-fourth the blade circumference distance by reducing veneer speed.

While preferred embodiments of the invention have been illustrated and described, it will be appreciated that various changes can be made therein without departing from the spirit and scope of the invention. For example, the blade holder may be constructed to have only one or as many as three or four blades projecting from oppositely-disposed channels. While two opposed blades are desirable because of the low mass and weight of the blade holder, one or more than two blades may be utilized. Consequently, the invention can be practiced otherwise than as specifically described herein.

The embodiments of the invention in which an exclusive property or privilege is claimed are defined as follows:

1. A rotary cutting assembly for transversely cutting large sheets of material comprising:

(a) at least one rotary blade assembly;

(b) a conveyor belt for conveying material to and away from the region beneath said at least one rotary blade assembly, said conveyor belt having an outer surface and an inner surface, said outer surface acting as a cutting surface for said at least one rotary blade assembly;

(c) a flat platen positioned beneath the inner surface of said conveyor belt, and vertically aligned with said at least one rotary blade assembly, for supporting said conveyor belt when said conveyor belt is acting as a cutting surface for said at least one rotary blade assembly;

(d) at least one back-up roller positioned above said at least one rotary blade assembly for preventing said at least one rotary blade assembly from longitudinally bending when said at least one rotary blade assembly is in a cutting position; and, (e) rotating means for rotating the rotary cutting assembly.

2. The rotary cutting assembly of claim 1, wherein said flat platen comprises a bearing surface insert held in place by a bearing surface holder.

3. A rotary cutting assembly of claim 2, wherein said bearing surface is formed of a low-friction metal material.

4. The rotary cutting assembly of claim 2, wherein said bearing surface is formed of a flexible low-friction material and wherein said bearing surface and said bearing surface holder form a cavity capable of holding a gas or fluid under pressure such that a change in the air or gas pressure inside said cavity causes said flexible surface to flex and to change height.

5. The rotary cutting assembly of claim 1, wherein said at least one rotary blade assembly comprises an elongated blade holder having at least one longitudinal channel, a blade removably retained within said at least one channel, and clamping means for securely fastening said blade within said at least one channel.

6. The rotary cutting assembly of claim 5, wherein said clamping means comprises a clamping assembly located in each of said at least one channel, each clamping assembly comprising: a tapered bar positioned on one side of the blade retained in the associated channel; a grooved clamp positioned on the other side of the blade retained in the associated channel; and, a plurality of threaded members mounted in said elongated blade holder and oriented to press said grooved clamp against said blade and said tapered bar to securely clamp said blade within said associated channel.

7. The rotary cutting assembly of claim 6, wherein said flat platen comprises a bearing surface insert held in place by a bearing surface holder.

8. The rotary cutting assembly of claim 7, wherein said bearing surface is formed of a low-friction metal material.

9. The rotary cutting assembly of claim 7, wherein said bearing surface is formed of a flexible low-friction material, and wherein said bearing surface and said bearing surface holder form a cavity capable of holding a gas or fluid under pressure such that upon a change in the air or gas pressure inside said cavity causes said flexible surface to flex and change height.

10. A rotary blade assembly for use on machines that transversely cut large sheets of material comprising:

(a) an elongate blade holder having a pair of opposed sides that taper outwardly toward one another from a central location to define a pair of opposed edges such that the distance between the edges is substantially greater than the distance between the sides at said central location, and a longitudinal channel formed in each of said oppositely-disposed edges;

(b) a blade removably retained in each of said channels, said blade having at least one cutting edge; and, (c) clamping means for securely clamping said blade in said channel.

11. The rotary blade assembly of claim 10, wherein said clamping means comprises a clamping assembly located in each of said at least one channel, each clamping assembly comprising: a tapered bar positioned on one side of the blade retained in the associated channel; a grooved clamp positioned on the other side of the blade retained in the associated channel; and, a plurality of threaded members mounted in said elongated blade holder and oriented to press said grooved clamp against said blade and said tapered bar to securely clamp said blade within said associated channel.

* * * * *